US006318444B1

(12) United States Patent
Ohnsmann et al.

(10) Patent No.: US 6,318,444 B1
(45) Date of Patent: Nov. 20, 2001

(54) DEVICE FOR CHARGING HORIZONTAL AND VERTICAL COLD CHAMBER PRESSURE DIE-CASTING MACHINES WITH METAL AND METHOD

(76) Inventors: Gustav Ohnsmann, Adlerstrasse 12, 84036 Landhut; Gerold Bandt, Buchenstrasse 1, 84098 Hohenthann, both of (DE)

( * ) Notice: Subject to any disclaimer, the term of this patent is extended or adjusted under 35 U.S.C. 154(b) by 0 days.

(21) Appl. No.: 09/235,168

(22) Filed: Jan. 22, 1999

(30) Foreign Application Priority Data

Jan. 22, 1998 (DE) ..... 198 02 342

(51) Int. Cl.[7] ..... B22D 17/00

(52) U.S. Cl. ..... 164/113; 164/312; 164/119; 164/306

(58) Field of Search ..... 164/113, 312, 164/119, 306

(56) References Cited

U.S. PATENT DOCUMENTS 4,777,998 * 10/1988 Charbonnier ..... 164/312 X
5,246,055 * 9/1993 Fields et al. ..... 164/113 X
5,429,174 * 7/1995 Wahnsiedler ..... 164/113

* cited by examiner

*Primary Examiner*—Nam Nguyen
*Assistant Examiner*—I-H. Lin
(74) *Attorney, Agent, or Firm*—Brezina & Ehrlich

(57) ABSTRACT

An apparatus for charging horizontal and vertical cold chamber pressure die-casting machines with metal, includes a pressure chamber having a first end which connects to a cold chamber pressure die casting machine, and an interchangeable receptacle, arranged underneath or laterally underneath the pressure chamber, the receptacle including a riser pipe which extends upwardly from a first end immersed in molten metal in the receptacle through a gas-tight cover on the receptacle to a second end. A pressure or aspirating line is fastened on the cover and connected at a first end to the second end of the riser pipe, and is connectable at a second end to a mid-point in the pressure chamber. A pressure piston including a drive rod is disposed in the pressure chamber adjacent the second end and a plate is disposed in the receptacle such that it contacts the molten metal in the receptacle on its surface, during delivery of the molten metal to the casting machine and during return of remaining molten metal from the casting machine.

14 Claims, 4 Drawing Sheets

Figure 1:
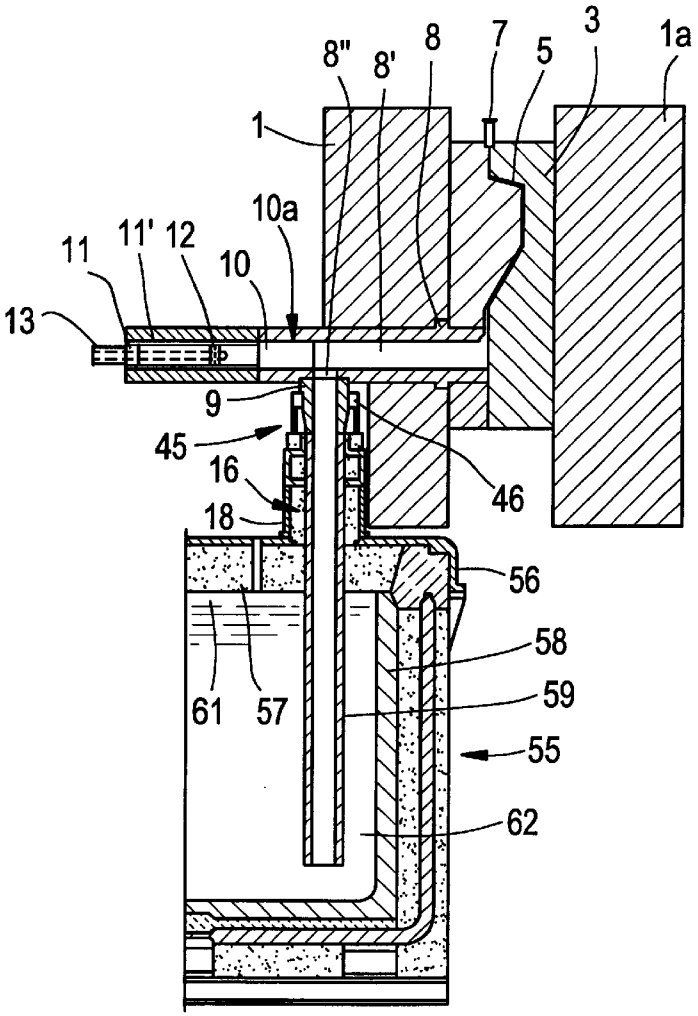

DEVICE FOR CHARGING HORIZONTAL AND VERTICAL COLD CHAMBER PRESSURE DIE-CASTING MACHINES WITH METAL AND METHOD

The invention relates to a device and a method for charging horizontal and vertical cold chamber pressure die-casting machines with metal.

The generally known cold chamber die casting method is not sufficiently suitable for producing pressure die castings of high ductility because of the entrained air as well as the impurities in the molten mass and the gas absorption as a result of the turbulent molten mass feeding into the pressure chamber, as well as the size of the pressure chamber, which can only be filled to approximately 50%. Also, heat treatments or coatings above 400° C. are not possible without the danger of bubble formation. In order to prevent these disadvantages and to do justice to the increasingly rising demand for ductile, heat-treated castings, the so-called "Vacural—Die-Casting Method" is increasingly employed. Here, the pressure chamber charge takes place by means of a vacuum generated over the casting mold, wherein a riser pipe inserted into the molten mass of a stationary holding furnace fills the pressure chamber. Here, too, chemical reactions as well as gas absorption of the molten mass occur during,the withdrawal of the metal from the pressure chamber transfer opening to the holding furnace because of the aspiration of air. For example, the adhesion of oxides in the pressure chamber cannot be prevented, which considerably reduces the service life of the pressure chamber and the pressure piston. In addition, the leakages being created from this during the filling of the pressure chamber lead to additional swirling of the casting material because of the aspiration of air.

Moreover, making the casting material available by operating holding furnaces, as well as the charging of the holding furnaces, which are arranged stationary on the pressure die-casting machines, with liquid metal, represents an avoidable waste of resources. For example, DE 196 13 668 C1 shows a system for providing and supplying metal, wherein a furnace provides the functions of a casting and holding furnace as well as of a transport container by changing its cover.

SUMMARY OF THE INVENTION

It is the object of the invention to disclose a device and its method, wherein the entire casting process takes place under the exclusion of air. This is attained: by a vertical, or respectively lateral, arrangement of the casting furnaces in respect to the pressure chamber, having a pressure, or respectively aspirating line, which is fastened by means of a housing on the furnace cover and whose riser pipe is inserted into the casting furnace pressure container filled with the molten mass, wherein a movable connecting line and its actuating device assures the hermetic as well as intermittent connection with the pressure chamber. Moreover, there is a gas injection piston between the pressure piston and its drive rods which, together with the guide bush of the latter, forms a hermetic gas injection ring conduit. The pressure chamber is filled with casting material by means of an appropriate gas pressure buildup over the surface of the molten mass in the casting furnace pressure vessel, or by the buildup of a vacuum over the casting mold. After closing the metal transfer opening by means of the pressure piston entering the pressure chamber for the purpose of filling the casting mold, in the course of filling the pressure chamber with casting material by means of gas pressure, the gas pressure over the surface of the molten mass in the casting furnace pressure chamber is reduced, and the remaining molten mass on the surface of the pressure piston casing is withdrawn into the casting furnace by means of aspiration or of an appropriate gas pressure when the gas injection ring conduit is opened. In the process, gas injection of the remaining molten mass with inert gas is performed. The gas pressure buildup and reduction, as well as the atmospheric gas pressure equalization during the filling of the pressure chamber by means of a vacuum over the surface of the molten mass in the casting furnace pressure chamber, takes place by means of a closed inert gas cycle. Following the removal of the casting, return of the pressure piston and closing the casting mold, during the next filling of the pressure chamber the air is pushed out of the pressure chamber and the casting mold by the inert gas present in the pressure, or respectively aspirating line, as well as in the riser pipe.

The supply with molten mass, as well as the return of the remaining molten mass which could not be cast, takes place directly from and to the foundry. The conversion of the casting furnace into a liquid metal transport container, which is also used as a liquid metal buffer by heating, is performed by means of a change of the furnace cover. A free-floating plate is placed into the surface of the molten mass for minimizing the movement of the molten mass bath. After conversion of the transport container filled with molten mass into a casting furnace by changing the cover, the air in the pressure, or respectively aspirating line, as well as that above the surface of the molten mass in the casting furnace pressure container, is displaced by the application of inert gas.

This object is attained by means of an installation and a method according to the invention.

The duration of the pressure chamber temperature is a positive or negative variable, because of its rise from approximately 20° C. to approximately 200° C. at the start of the casting process, as well as of its drop after the casting process has been interrupted or terminated. Because of these problems, in accordance with the prior art the riser pipes are made of a pipe which is immersed into the molten mass with its lower end and is connected in a gas-tight manner with the pressure chamber. The changes of the position of the pressure chamber here present no problems because of an opening in the casting furnace. Filling of the pressure chamber and withdrawing of the remaining molten mass leads to a continuous movement of the molten mass bath under the influence of air, which leads to chemical reactions as well as to an absorption of gas in the molten mass. This, as well as the withdrawal of the remaining molten mass by the aspiration of air, has the result that the riser pipes are again and again clogged by oxides as well as by components of the molten mass. The problem can also not be solved by ceramic filters inserted into the riser pipe, since the oxides formed during the withdrawal of the remaining molten mass are present in the casting furnace at the bath level of the molten mass. Also, abrasive wear, along with corresponding formations of hollow spaces and oxide adhesions, in particular in the area of the molten mass transition of the pressure chamber, cannot be prevented by this. In addition, because of the heat loss, the riser pipes must be heated. By means of the advantageous design of the pressure, or respectively aspirating line via a steel housing which is screwed to the furnace cover and is designed to be spatially variable, the movable connecting line with inclined embodiment of the separation surface with the connection flange of the pressure chamber, t he withdrawal of the remaining molten mass without contact with the air by means of the gas injection piston and inert gas, the displacement of the air out of the pressure chamber by the inert gas located in the pressure, or respectively aspirating line and the riser pipe, and the closed casting mold during the filling of the pressure chamber by means of gas pressure, as well as the interruption of direct heat removal by ceramic or fiber-ceramic materials for all heat-conducting components, it is possible to achieve a filling of the pressure chamber, during which the described disadvantages are avoided.

To assure the hermetic connection between the pressure chamber flange and the movable connecting line, the inclined separating surface of the latter is embodied in such a way that at the start of the casting process the longitudinal expansion of the pressure chamber is compensated by a seal located in the separating surface, as well as the continuous contact pressure of the actuating device on the connecting line. The shrinking forces of the pressure chamber on the movable connecting line, which occur at the interruption or termination of the casting process, are equalized by a chronologically adjustable restoring impulse from the pressure die-casting machine on the actuating device of the movable connecting line. In this case the charging of the pressure chamber with casting metal can take place by means of a buildup of inert gas over the surface of the molten mass in the pressure chamber, or by generating a vacuum above the casting mold. When the pressure chamber is filled, the pressure piston presses the liquid metal into the casting mold wherein, following the closing of the pressure chamber metal transfer opening by the incoming pressure piston, the pressure over the surface of the molten metal in the pressure chamber is reduced during the charging with metal under gas pressure, and the column of liquid metal at the pressure piston casing is withdrawn into the pressure container by means of aspiration of inert gas or by means of an appropriate inert gas pressure from the opening gas injection conduit of the gas injection piston. The supply of metal takes place by means of transport containers delivered directly from the foundry, wherein the liquid metal in the transport container can be buffered by heating, or can be immediately cast by means of a change in the furnace cover. To minimize the movement of the metal, a free-floating submerging plate is provided on the surface of the molten mass during the delivery from, as well as the return of the remaining amounts to the foundry.

Advantageous embodiments and further developments of the invention, as well as of the method are described in the dependent claims.

The device in accordance with the invention for charging horizontal and vertical pressure die-casting machines with metal and the method for this, make possible a casting production under the exclusion of chemical reactions and of a gas absorption by the molten mass to be cast. In this case the ductility of the casting is considerably increased, oxide adhesions, as well as great abrasive wear caused by oxides, are made impossible, the service life of the pressure chamber, the pressure piston and of the casting mold are increased, the casting waste is reduced and production interruptions and repair outlays are minimized. Moreover, a heating operation as well, as the metal supply for the casting furnaces at the pressure die-casting machines is no longer required because of the rapid exchange of the casting furnaces at the pressure die-casting machines, the buffering of the liquid metal in the transport containers, the delivery of liquid metal, as well as the return of the liquid metal, which cannot be cast, from and to the foundry. This results in great savings in respect to investment, personnel and repair costs.

Figure 2:
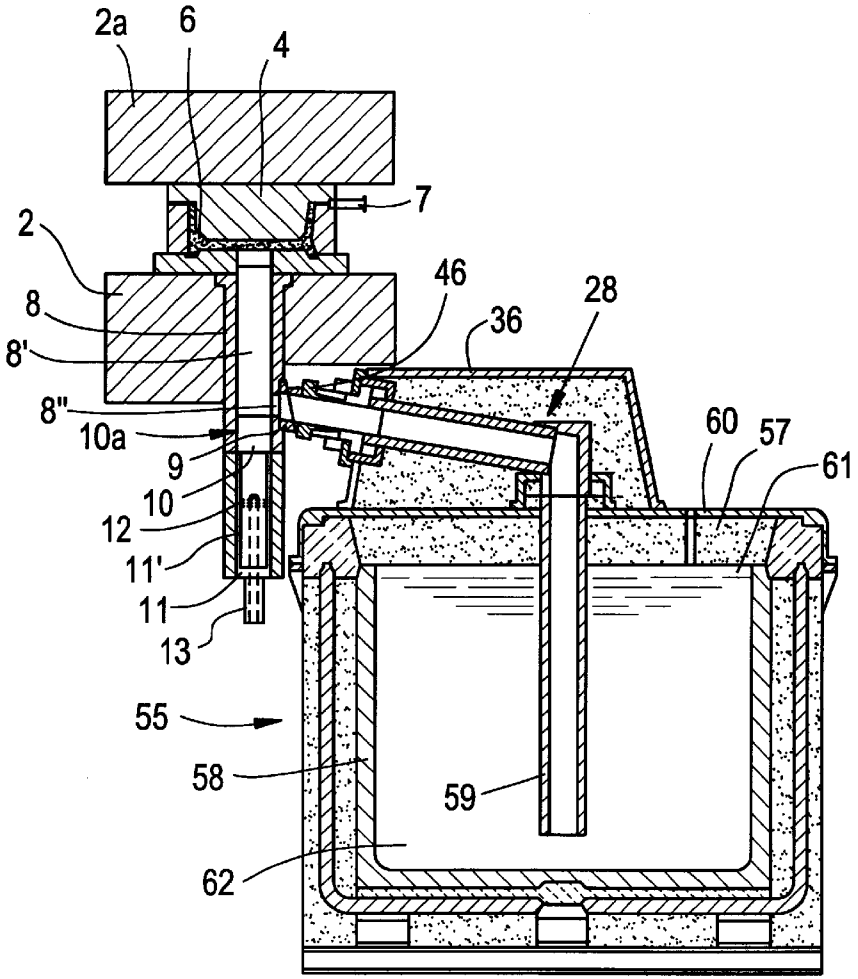
Figure 3:
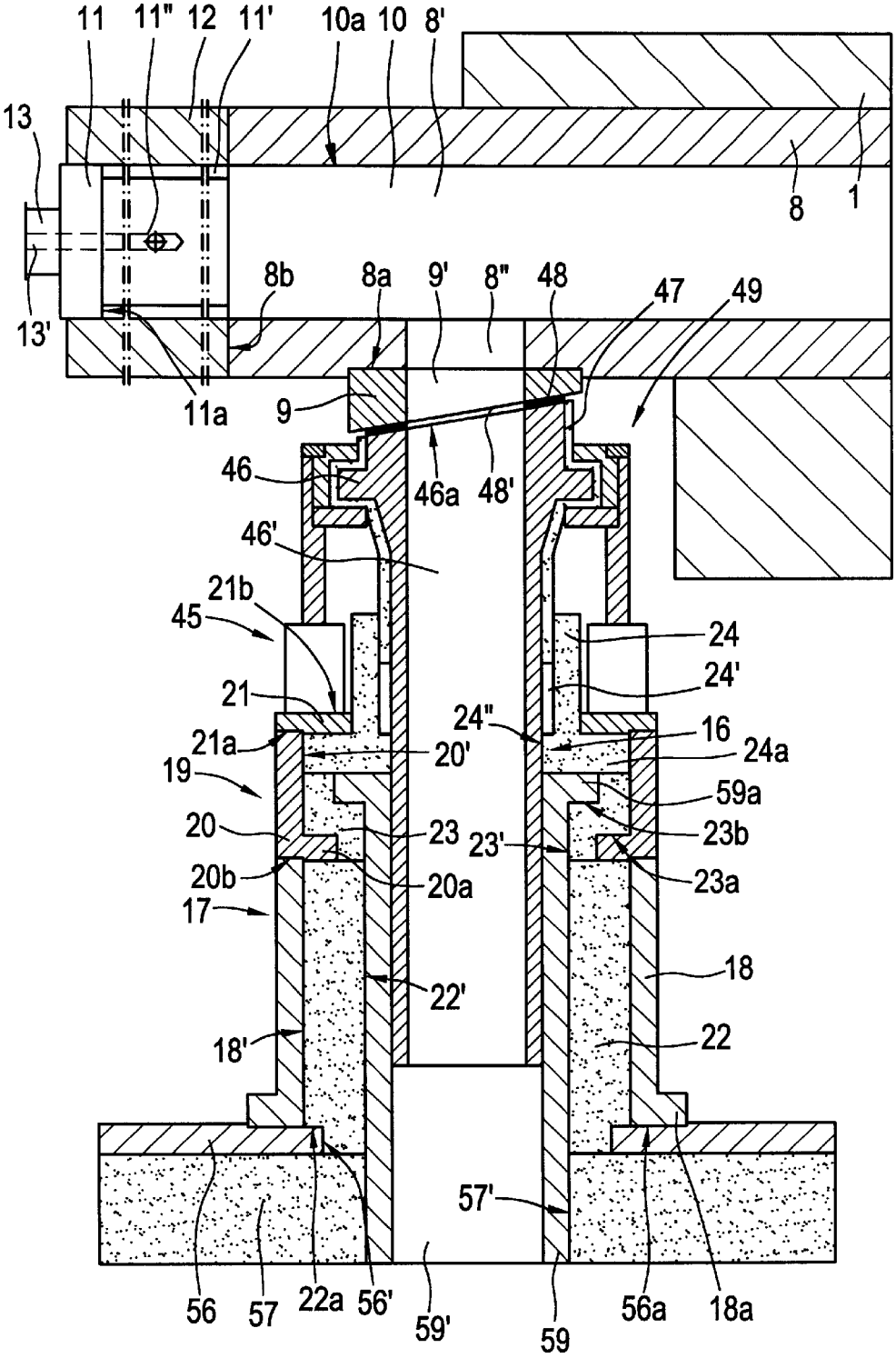
Figure 4:
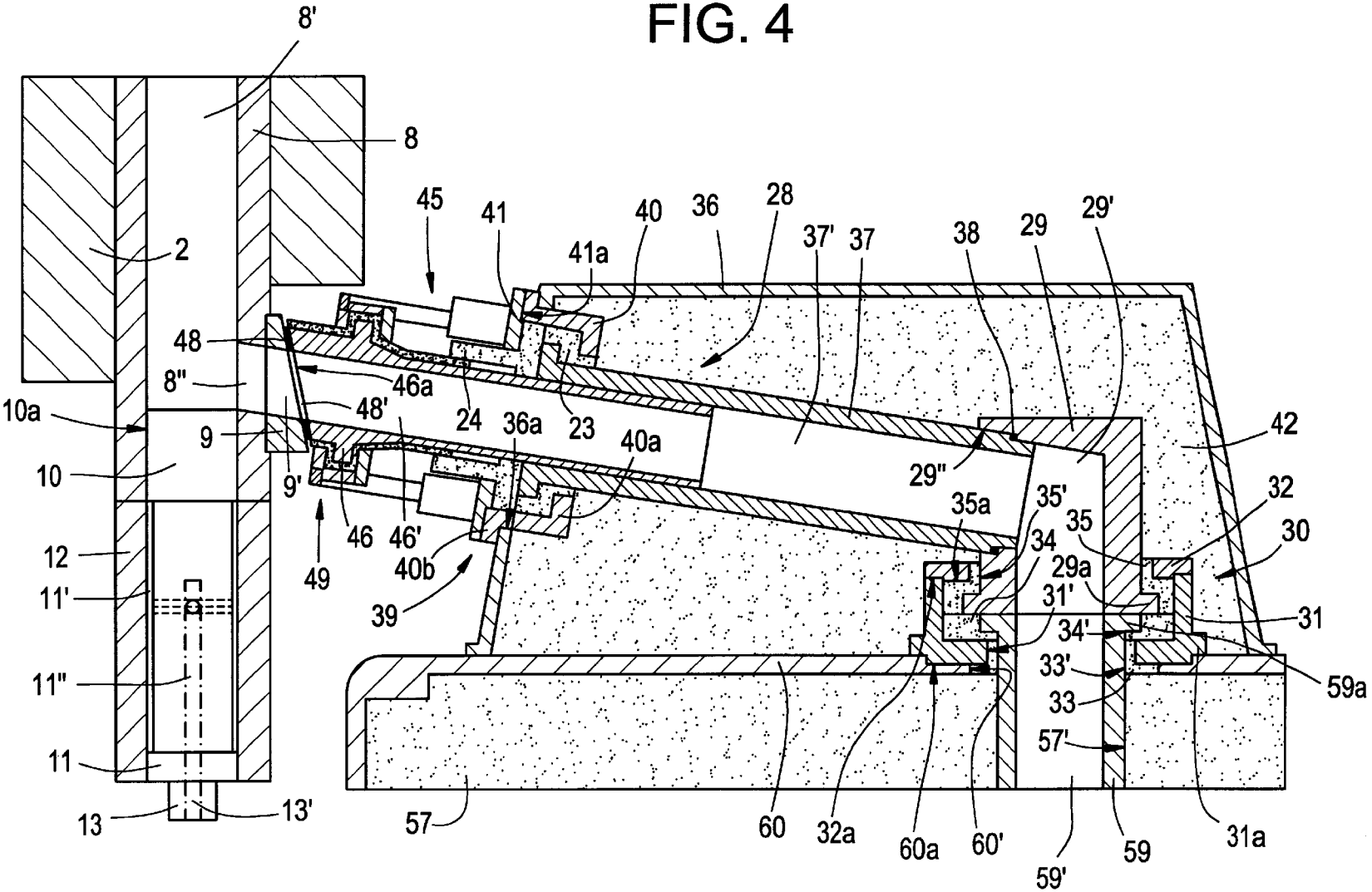
Figure 5:
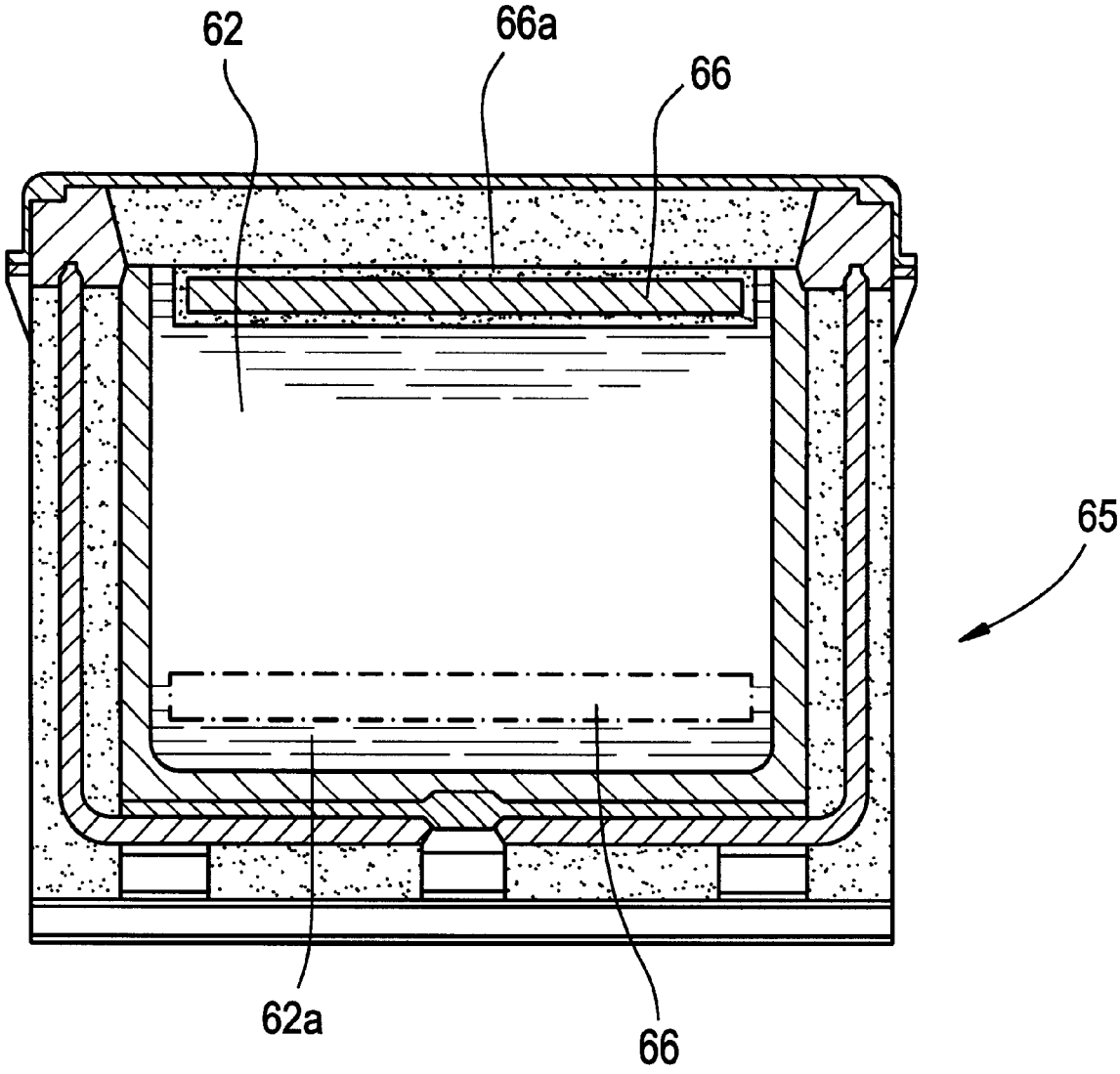

Further advantages of the invention will become apparent from the following drawings, in which FIG. 1 is a longitudinal section through a device in accordance with invention for charging a horizontal cold chamber pressure die-casting machine with metal, FIG. 2 is a longitudinal section through device in accordance with invention for charging a vertical cold chamber pressure die-casting machine with metal, FIG. 3 is a first exemplary embodiment of charging a horizontal pressure chamber with metal, FIG. 4 is a further exemplary embodiment of charging a vertical pressure chamber with metal, and FIG. 5 is an exemplary embodiment of the plate being immersed in the surface of the molten mass of the liquid metal transport container.

DESCRIPTION OF THE PREFERRED EMBODIMENTS

The horizontal and vertical cold chamber pressure die-casting machines 1, 1*a* and 2, 2*a*, schematically represented in FIG. 1 and FIG. 2, show a casting mold 3, 4, a casting 5, 6 to be produced, the pressure chamber 8, the pressure chamber flange 9, the pressure piston 10, the gas injection piston 11 with the guide bushing 12, the pressure, or respectively aspirating line 16, 28 with the movable connecting line 46, the actuating device 45, the casting furnace 55 and the furnace riser pipe 59 inserted into the molten mass 62 in the pressure container 58. In this case, the pressure, or respectively aspirating line 16, as well as the casting furnace 55 of the horizontal cold chamber pressure die-casting machine 1, 1*a* are arranged vertically underneath the pressure chamber as well as the pressure die-casting machine 1, 1*a*. With the vertical cold chamber pressure die-casting machine 2, 2*a*, the pressure, or respectively aspirating line 28 is embodied inclined in relation to the pressure chamber 8 and has been installed, together with the casting furnace 55, laterally of the pressure chamber 8 underneath the pressure die-casting machine 2, 2*a*. The employment of the pressure chamber dimensions, which have been used up to date, is assured by means of the recesses in the fixed identification plates 1, 2 of the horizontal and vertical cold chamber pressure die-casting machines 1, 1*a* and 2, 2*a*. By means of this, the steel housings 18, 36, whose dimensions can be made variable, of the pressure, or respectively aspirating line 16, 28, can do justice to all size requirements in respect to the pressure die-casting machines as well as the different positions of their pressure chambers. Moreover, the casting furnace 55 can be employed with any arbitrary cold chamber pressure die-casting machine by changing the furnace cover with the corresponding pressure, or respectively aspirating chamber.

In particular, in an example in accordance with FIG. 3, the pressure, or respectively aspirating line 16, the steel housing 17, the actuating device 45, the pressure chamber flange 9, the gas injection piston 11 and the guide bushing 12 are represented in detail for a horizontal cold chamber pressure die-casting machine 1, 1*a*. Here, the pressure, or respectively aspirating line 16 is embodied via a furnace riser pipe 59 and a movable connecting line 46. Centering and guidance of the movable connecting line 46 is provided here by the interior jacket 59' of the furnace riser pipe. The pressure, or respectively aspirating line 16 is fixed in place and positioned by means of the steel housing 17, as well as by the actuating device 45. The steel housing 17, which has been vertically fastened on the furnace cover 56, is formed by a spacer housing 18, a coupling 19, a sleeve 22, as seating ring 23 as well as a seating shell 24. The steel housing 17 is arrested in its position and fixed in place by a center collar 18*a* on the bottom surface of the spacer housing 18 and by a recess 56*a* on the furnace cover 56. The sleeve 22, which has been inserted in the hollow chamber 18' of the spacer housing 18, is positioned in respect to the furnace cover opening 56'by means of a shoulder 22*a*. The coupling 19 is centered in respect to the spacer housing 18 and screwed in by means of a shoulder 20*b* in the bottom surface of the coupling housing 20, as well as by the cover plate shoulder 21*a*. A collar 20*a*projecting into the hollow chamber 20' of the coupling housing 20 positions the seating ring 23, which has been inserted into the coupling hollow chamber 20' by means of a shoulder 23*a*. Here, the furnace riser pipe 59 is fixed in place by means of the openings of the furnace cover lining 57', of the sleeve 22', as well as of the seating ring 23'. The shoulder 23*b* in the upper cover surface of the seating ring 23 receives the furnace riser collar 59*a*. The furnace riser pipe 59, the seating shell 24, as well as the seating ring 23 are fixed in place by means of the bottom cover surface of the seating shell 24, as well as by the pressure acting on the collar 24*a* of the seating shell 24 through the coupling cover plate 21. The seating shell 24 has a continuous opening 24' starting at the upper front face which, starting at the collar 24*a*, makes an offset transition into a smaller opening 24". In this case the large seating shell opening 24' receives the insulating casing 47 of the connecting line 46 and, because of the remaining free space, allows the movement of the connecting line 46 without interrupting its continuous heat insulation. The time-controllable actuating device 45 of the connecting line 46 is connected with the cover plate surface 21*b* of the coupling 19 and is centered. The connecting line 46 is connected with the actuating device 45 by means of a claw 49. The sleeve 22, the seating ring 23, the seating shell 24, as well as the casing 47 of the connecting line 46 are made of ceramic or fiber-ceramic materials. In this way the heat-conducting components are protected against heat losses. The pressure chamber flange 9, which has been inserted into the pressure chamber 8 via a shoulder 8*a*, together with the end face 46*a* of the connecting line 46 and with the interposition of a seal 48, form an inclined, hermetic and intermittent connection. For preventing chemical reactions, as well as the gas absorption during the withdrawal of the molten mass present in the pressure chamber 8", in the pressure chamber flange 9', in the seal 48', in the connecting line 46' as well as in the spacer pipe 37', in the plug seating 29' see FIG. 4, as well as of the melt in the furnace riser pipe 59', a gas injection piston 11 with a guide bushing 12 is arranged between the pressure piston 10 and its drive rods 13. In this case the gas injection piston 11, which is connected with the pressure piston 10, together with the guide bushing 12, forms a hermetic gas injection ring conduit 11' by means of a shoulder 11*a* on the gas injection piston 11. The guide bushing 12 is here connected, centered on the front face 8*b*, with the pressure chamber 8. The gas injection ring conduit 11' is connected via the conduits 11" and 13' with an inert gas source through the drive rods 13.

FIG. 4 shows a further exemplary embodiment in detail. Because of the vertical pressure chamber 8, as well as the required metal withdrawal, the pressure, or respectively aspirating line 28 is embodied here inclined in respect to the pressure chamber 8. The pressure, or respectively aspirating line 28 is formed by a furnace riser pipe 59, a plug seating 29, a spacer pipe 37 as well as a movable connecting line 46. The pressure, or respectively aspirating line 28 is arrested in its position and fixed in place by means of a coupling 30, fastened and centered on the furnace cover 60, by a coupling 39, which is positioned on the steel housing 36, by the actuating device 45, which is fastened on the coupling cover plate 41, as well as by the steel housing 36 screwed on the furnace cover 60. The coupling 30 is constituted by a housing 31, a cover plate 32, a disk 33, a seating ring 34 as well as a seating sleeve 35. The coupling housing 31 is screwed together with the furnace cover 60 and centered by means of a shoulder 60*a* and the collar 31*a*. The furnace cover opening 60' as well as the housing opening 31' receive the disk 33. The seating ring 34 as well as the seating sleeve 35 form the hollow chamber of the coupling housing 31. Here, the seating ring 34 receives the furnace riser pipe collar 59*a*, and the seating sleeve 35 the plug seating collar 29*a*. The cover plate 32, which has been centered on and connected with the coupling housing 31 by means of a shoulder 32*a*, fixes the seating sleeve 35, the seating ring 34, the plug seating 29 and the furnace riser pipe 59 in place by means of a shoulder 35*a*. The openings 59' and 29' are centered in respect to each other via the openings 57', 33', 34' and 35'. The disk 33, the seating ring 34 as well as the seating sleeve 35 are made of a ceramic or fiber-ceramic material. The offset opening 29" in the plug seating 29, which has been embodied in the inclined position of the spacer pipe 37, receives the correspondingly offset spacer pipe 37. The longitudinal thermal changes of the spacer pipe 37 are compensated by the flexible seal 38 interposed between the shoulders of the plug seating and spacer pipe. The coupling 39, which has been fastened on the front face of the steel housing 36 in the inclined position of the spacer pipe 37, is constituted by a housing 40, a cover plate 41, a seating ring 23 as well as a seating shell 24. Here, the housing 40 forms a collar 40*a*, which projects inward into the steel housing 36, as well as a collar 40*b*, which projects outward at the front face of the steel housing 36. The cover plate 41 is screwed together with and centered on the steel housing 36 via a shoulder 41*a*, and the housing 40 via the opening 36*a*. The steel housing 36, fastened and fixed in place on the furnace cover 60, protects and insulates the plug seating 29 as well as the spacer pipe 37 from damages as well as large heat losses. Here, the hollow chamber of the steel housing 36 is formed by the coupling 30, the plug seating 29, the spacer pipe 37 and the coupling 39 projecting into the hollow housing chamber. The remaining hollow space of the steel housing 36 is lined or filled with ceramic or fiber-ceramic material. Except for the guidance and centering of the movable connecting line 46 via the opening surface 37' of the spacer pipe, the further embodiment of the pressure, or respectively aspirating line 28, as well as the gas injection piston 11 and the guide bushing 12 is identical with the first exemplary embodiment in accordance with FIG. 3.

The transport container 65 represented in FIG. 5 has a freely floating plate 66 immersed in the molten material surface, whose immersion depth into the molten material 62 is determined by the buoyancy of the molten mass and the weight of the plate. The plate 66, which is made of a metallic material, has a ceramic or fiber-ceramic envelope 66*a*. The dash-dotted representation shows the remaining molten mass 62*a*, which cannot be die-cast, with the plate 66 immersed in the molten material. It is furthermore pointed out, that structural details can be designed quite differently from the exemplary embodiment represented without departing from the content of the claims.

The device for charging horizontal and vertical cold chamber pressure die-casting machines with metal operates as follows:

Prior to the production of castings 5, 6 by means of a horizontal or vertical cold chamber pressure die-casting machine 1, 1*a*, 2, 2*a*, the connecting line 46 is hermetically pressed with the end face 46*a* to the metal transfer surface of the pressure chamber flange 9 by means of an actuating device 45 under a continuous pressure. The charging with metal of the surge chamber 8' takes place by means of the control of the pressure die-casting machine through a buildup of inert gas over the surface 61 of the molten mass in the pressure container 58, or by generating a vacuum 7 over the casting mold 3, 4. With the horizontal pressure die-casting machine 1, 1*a*, the liquid metal 62 is here conveyed through the openings 59', 46', 48. 9', 8" into the surge chamber 8' of the pressure chamber 8. Following the filling of the pressure chamber, the pressure piston 10 moving into the surge chamber 8' presses the liquid metal into the casting mold 3, 4. With the casting metal being conveyed by gas pressure, the latter is reduced over the surface 61 of the molten mass in the pressure container 58 when the pressure chamber metal transfer opening 8' is closed by the pressure piston 10. The gas injection ring conduit 11' is opened in the direction of the metal transfer opening 8" of the pressure chamber 8 by means of the gas injection piston 11 connected with the inward moving pressure piston 10, and the molten mass 62 on the pressure piston casing 10*a* is withdrawn by the aspiration on inert gas into the pressure container 58. In this case the gas delivery takes place via the gas injection conduits 11', 11", 13', as well as a gas source connected with the drive rods 13, wherein the gas injection ring conduit 11' remains open toward the metal transfer opening 8" until the pressure piston end pressure position, so that by this the hermetic closure of the gas injection piston 11 toward the metal transfer opening 8" of the pressure chamber 8 is assured. After opening the casting mold and removing the castings, the pressure piston 10 returns from the cast metal press end position into the pressure chamber filling position. When the surge chamber 8' is charged with metal by means of gas pressure, the air being aspirated into the surge chamber 8' in the process is displaced out of it, as well as out of the casting mold 3, 4, by the inert gas located in the metal charging hollow chambers 59', 46', or respectively 59', 29', 37', 46'. After the conversion of the transport container 65 into a casting furnace 55, a manual inert gas injection of the metal charge openings 59', 46', or respectively 59', 29', 37', as well as 46', takes place. In this way it is possible for the entire casting process to be performed with the exclusion of air.

The longitudinal thermal change of the pressure chamber 8 at the start of the casting process is hermetically compensated by the inclined separation surface of the connecting line 46 and the pressure chamber flange 9 with the interposition of a seal 48, as well as by the pressure acting continuously on the connecting line 46 via the actuating device 45. If the casting process is interrupted or terminated, the return of the connecting line 46 from the pressure chamber flange transfer surface takes place by means of an adjustable, time-controlled pulse from the pressure die-casting machine 1, 1*a*, 2, 2*a* to the actuating device 45 for preventing thermal shrinking forces of the pressure chamber 8 acting on the connecting line 46.

The supply of casting metal as well as its buffering is provided via heatable transport containers 65 delivered from the foundry, which can be inserted directly into the metal charging position of the horizontal and vertical cold chamber pressure die-casting machines 1, 1*a*, 2, 2*a* by means of a change of the furnace covers. The remaining molten mass 62*a*, which cannot be cast, in the casting furnace 55 is returned to the foundry by means of changing the furnace cover into the transport container 65. A freely floating plate 66, which is immersed in the surface of the molten mass, is provided for minimizing the molten mass bath movements during the delivery of the liquid metal from, as well as return of the remaining amounts to the foundry.

What is claimed is:

1. An apparatus for charging horizontal and vertical cold chamber pressure die-casting machines with metal, comprising:

a pressure chamber having a first end constructed and arranged for connection to a cold chamber pressure die casting machine;

an interchangeable receptacle, arranged underneath or laterally underneath the pressure chamber, the receptacle comprising a riser pipe constructed and arranged to extend upwardly from a first end immersed in molten metal in the receptacle through a gas-tight cover on the receptacle to a second end;

a pressure or aspirating line fastened on the cover and connected at a first end thereof to the second end of the riser pipe, and at connectable a second end to a midpoint in the pressure chamber;

a steel housing providing a hermetic and separable seal with the pressure or aspirating line;

a pressure piston including a drive rod disposed in the pressure chamber adjacent the second end thereof with a gas injection piston with a guide bushing arranged between the pressure piston and the drive rod, and a plate disposed in the receptacle such that the plate contacts the molten metal in the receptacle on its surface, during delivery of the molten metal to the casting machine and during return of remaining molten metal from the casting machine.

2. Apparatus in accordance with claim 1, wherein the pressure or aspirating line is vertical and includes a detachable connecting line connecting to the pressure chamber.

3. Apparatus in accordance with claim 2, wherein the pressure or aspirating line in vertical and is fixed in place to the riser pipe and positioned by means of a spacer housing, a coupling, a sleeve, a seating ring, a seating shell, and an actuating device.

4. Apparatus in accordance with claim 1, wherein the pressure or aspirating line is inclined and comprises a plug seating and a seal connected to the riser pipe, a spacer pipe, and a connecting line sealingly slidable within the pressure or aspirating line connecting the pressure chamber to the pipe pressure or aspirating line.

5. Apparatus in accordance with claim 4, wherein the inclined pressure or aspirating line is fixed in place and positioned via the steel housing to the riser pipe with a coupling to the riser pipe, a disk, a seating ring, and a seating sleeve, and a seating shell and an actuating device at the first end of the pressure or aspirating line.

6. Apparatus in accordance with claim 5, wherein an exposed portion of the connecting line, a liner for the steel housing, the sleeve, the disk, the ring, the shell, and the sleeve, comprise ceramic or fiber-ceramic materials.

7. Apparatus in accordance with claim 4, additionally comprising a flexible seal in the plug seating for compensating for thermal length changes of the pressure or aspirating line.

8. Apparatus in accordance with claim 1, additionally comprising a pressure chamber flange forming an inclined surface with an end face of the pressure or aspirating line.

9. Apparatus in accordance with claim 8, wherein the pressure chamber flange is made of a ceramic material.

10. Apparatus in accordance with claim 8, additionally comprising means for compensating for longitudinal thermal expansion of the pressure chamber, said means comprising a connecting line sealingly slidable within the pressure or aspirating line, and actuating means causing an end of the connecting line to be pressed with constant pressure against the pressure chamber flange, resulting in a hermetic seal between the pressure or aspirating line and the pressure chamber flange.

11. Apparatus in accordance with claim 10, additionally comprising means for compensating for a buildup of longitudinal shrinkage forces in the pressure chamber, said means comprising means for providing a time-controlled return impulse from the pressure die-casting machine to the actuating device at termination or interruption of casting.

12. Apparatus in accordance with claim 1, wherein the gas injection piston, the pressure piston and the guide bushing form a hermetic gas injection ring conduit.

13. Apparatus in accordance with claim 1, wherein the plate is made of metallic material with a ceramic or fiber-ceramic envelope.

14. A method for charging horizontal and vertical cold chamber pressure die-casting machines with metal, comprising the steps of:

providing an apparatus comprising:

a pressure chamber having a first end constructed and arranged for connection to a cold chamber pressure die casting machine;

an interchangeable receptacle, arranged underneath or laterally underneath the pressure chamber, the receptacle comprising a riser pipe constructed and arranged to extend upwardly from a first end immersed in molten metal in the receptacle through a gas-tight cover on the receptacle to a second end;

a pressure or aspirating line fastened on the cover and connected at a first end thereof to the second end of the riser pipe, and connectable at a second end to a mid-point in the pressure chamber via a connecting line slidable within the pressure or aspirating line and a pressure chamber flange;

a steel housing providing a hermetic and separable seal with the pressure aspirating line;

a pressure piston including a drive rod disposed in the pressure chamber adjacent the second end thereof with a gas injection piston with a guide bushing arranged between the pressure piston and the drive rod; and a plate disposed in the receptacle such that it contacts the molten metal in the receptacle on its surface, during delivery of the molten metal to the casting machine and during return of remaining molten metal from the casting machine;

filling the receptacle with molten metal and connecting the first end of the pressure chamber to a casting machine;

contacting an end face of the connecting line with the pressure chamber flange;

causing conveyance of molten metal from the receptable to a surge chamber in the pressure chamber by building up gas pressure over the molten metal in the receptacle or by creation of a vacuum in the casting mold;

filling the casting mold by the moving the pressure piston towards the casting mold into the surge chamber, gas pressure over the molten metal being reduced by closure of the pressure chamber to the connecting line by movement of said piston, and withdrawing remaining molten mass into the receptacle by withdrawal of the piston, any air contained in the pressure or aspirating line and over the molten metal in the receptacle being displaced by means of inert gas absorption;

wherein following the withdrawal of the piston, the molten metal on the piston is withdrawn into the pressure container by means of an inert atmospheric or greater than atmospheric gas pressure, and that after renewed filling of the surge chamber by means of said inert gas pressure, any air located in the surge chamber and the casting mold is displaced by the inert gas in the pressure or aspirating line and in the riser pipe.

* * * * *